United States Patent [19]

Snygg et al.

[11] 4,095,755

[45] Jun. 20, 1978

[54] RIDER ROLL ASSEMBLY IN A WINDER

[75] Inventors: Keijo Kalevi Snygg, Karhula; Aarne Johannes Korkolainen, Kotka, both of Finland

[73] Assignee: A. Ahlstrom Osakeyhtio, Finland

[21] Appl. No.: 773,619

[22] Filed: Mar. 2, 1977

[30] Foreign Application Priority Data

Mar. 12, 1976 Finland ..... 760643

[51] Int. Cl.[2] ..... B65H 17/08

[52] U.S. Cl. ..... 242/66

[58] Field of Search ..... 242/66, 65, 67.1 R, 242/67.2, 67.3 R, 67.5, 56.1, 56.2, 56.6, 64, 69, 55

[56] References Cited

U.S. PATENT DOCUMENTS

| | | | |
|---|---|---|---|
| 3,104,845 | 9/1963 | Patterson | 242/66 |
| 3,512,727 | 5/1970 | Palovaara | 242/66 |
| 3,837,593 | 9/1974 | Dorfel | 242/66 |

FOREIGN PATENT DOCUMENTS

| | | | |
|---|---|---|---|
| 561,591 | 10/1957 | Belgium | 242/65 |

*Primary Examiner*—Edward J. McCarthy
*Attorney, Agent, or Firm*—Bucknam and Archer

[57] ABSTRACT

A rider roll assembly in a winder for winding webs of paper or other webs, by means of which a load can be applied on the wound web roll during the winding operation. The rider roll arrangement comprises a movable transversal load beam and one or several load rolls. In order to prevent vibration of the load roll or rolls, the roll or rolls are connected to the load beam by vibration absorbing means.

6 Claims, 4 Drawing Figures

RIDER ROLL ASSEMBLY IN A WINDER

This invention relates to a rider roll which can be used in winders for winding webs of paper and other webs and by means of which a load on the wound web roll can be applied during the winding operation. In order to achieve a uniform nip pressure between the rider roll and the web roll the rider roll often consists of several adjacent short rolls being movable independently of each other.

A rider roll system of this type is disclosed in the U.S. Pat. No. 3,837,593. This particular patent shows an application where the winding of the web is performed in a winder provided with two supporting drums. The rider roll consists of several load rolls which are attached to a transversal beam and which are each provided with a hydraulic or pneumatic loading apparatus. By means of this arrangement a uniform distribution of the load along the wound roll can be achieved. An irregular shape of the wound roll can cause vibration when the roll is rotating, which further increases its irregularity.

It is an object of the invention to provide a rider roll of the above-mentioned type, whereby the vibration caused by the shape of the roll is eliminated.

According to the invention, vibration absorbing means are provided between the transversal load beam and each load roll.

The invention is described more in detail in the following with reference to the accompanying drawings.

Figure 1:
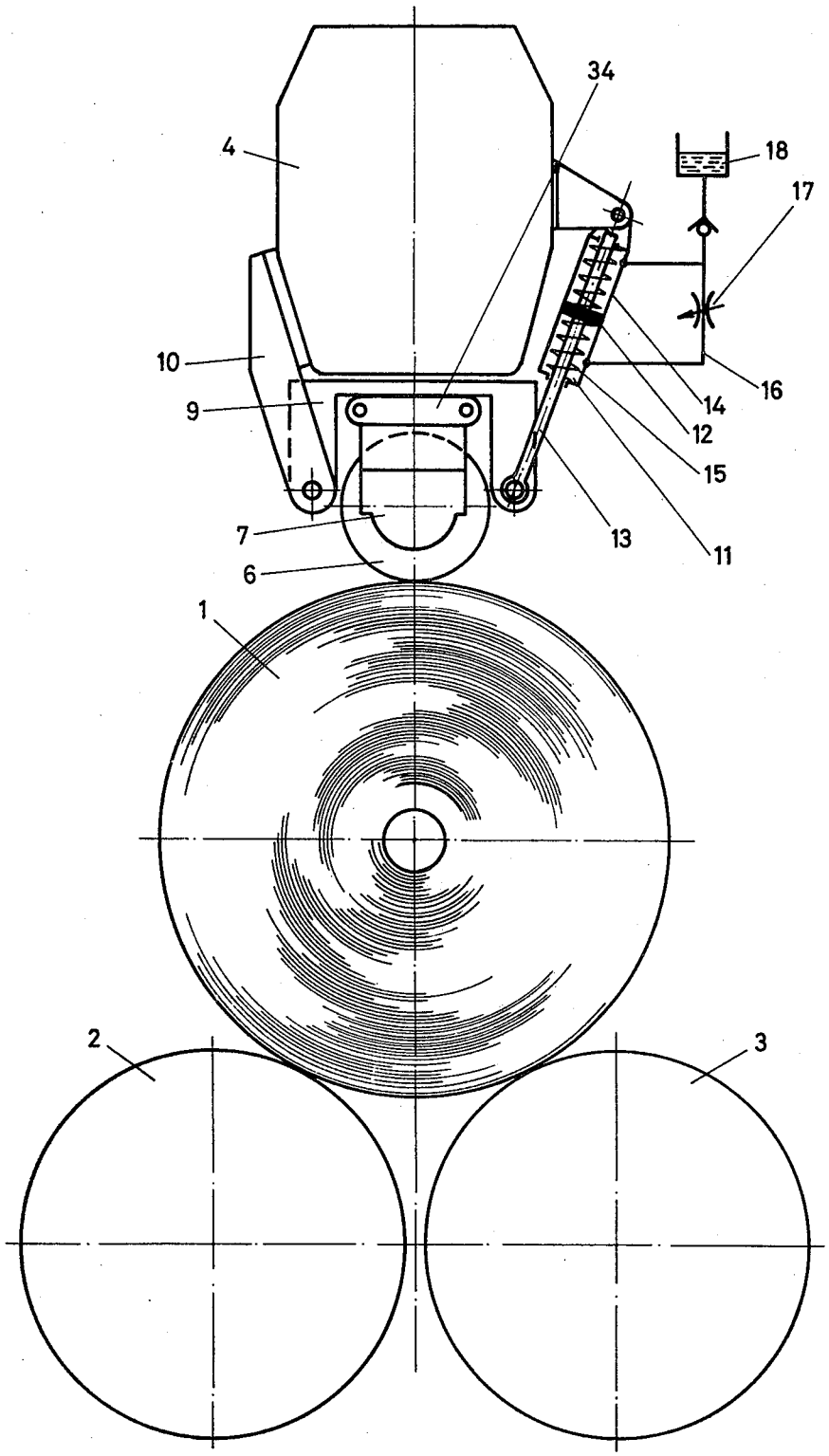
Figure 2:
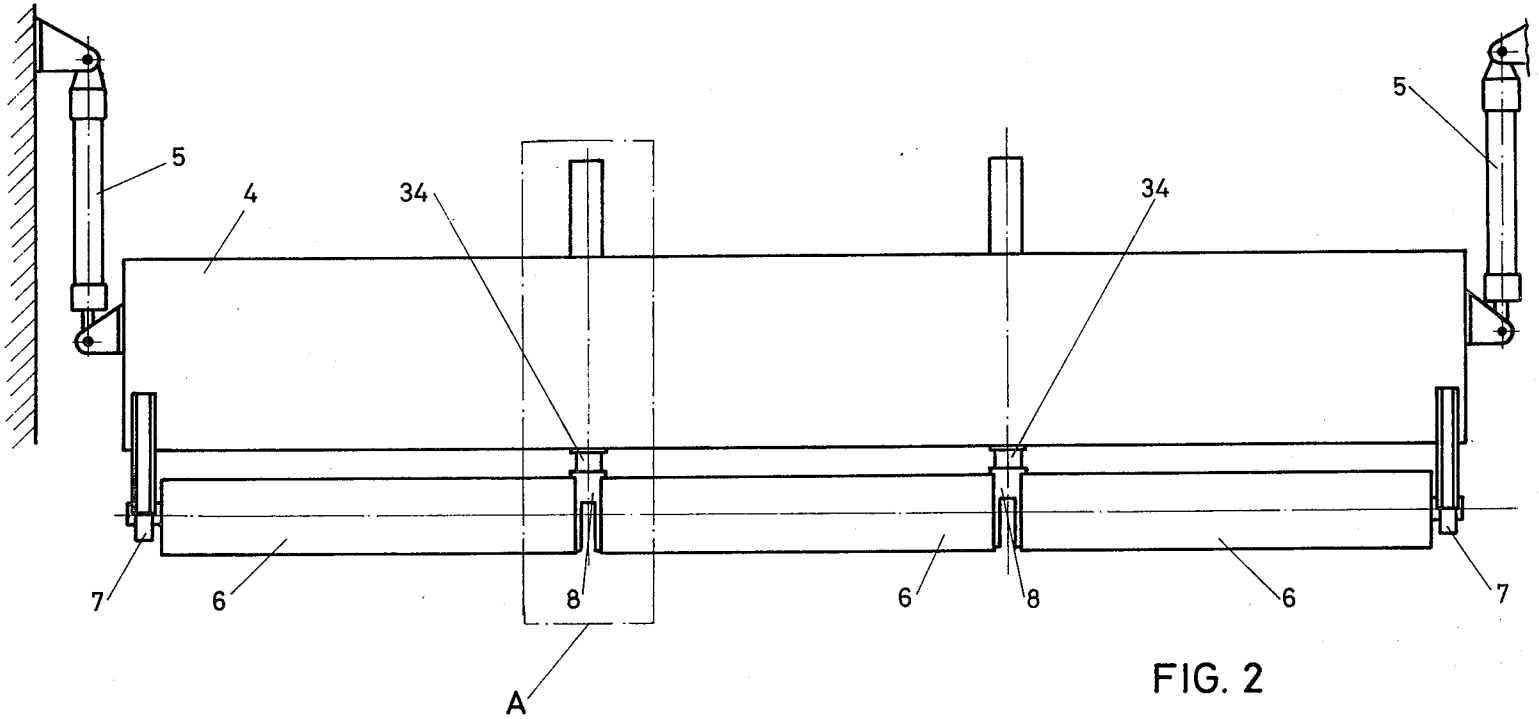
Figure 4:
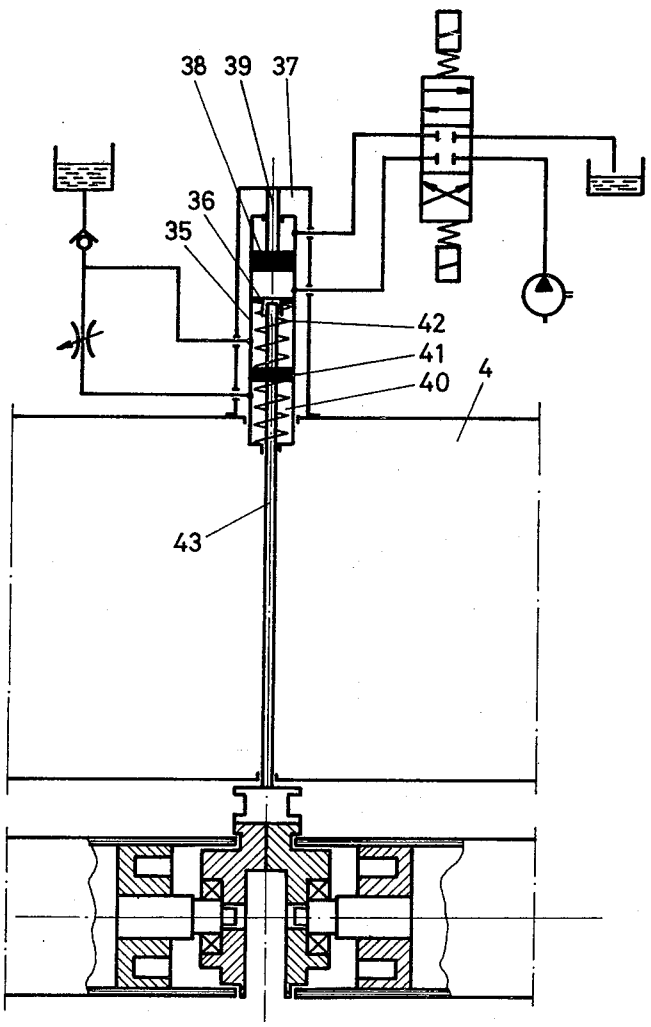
Figure 3:
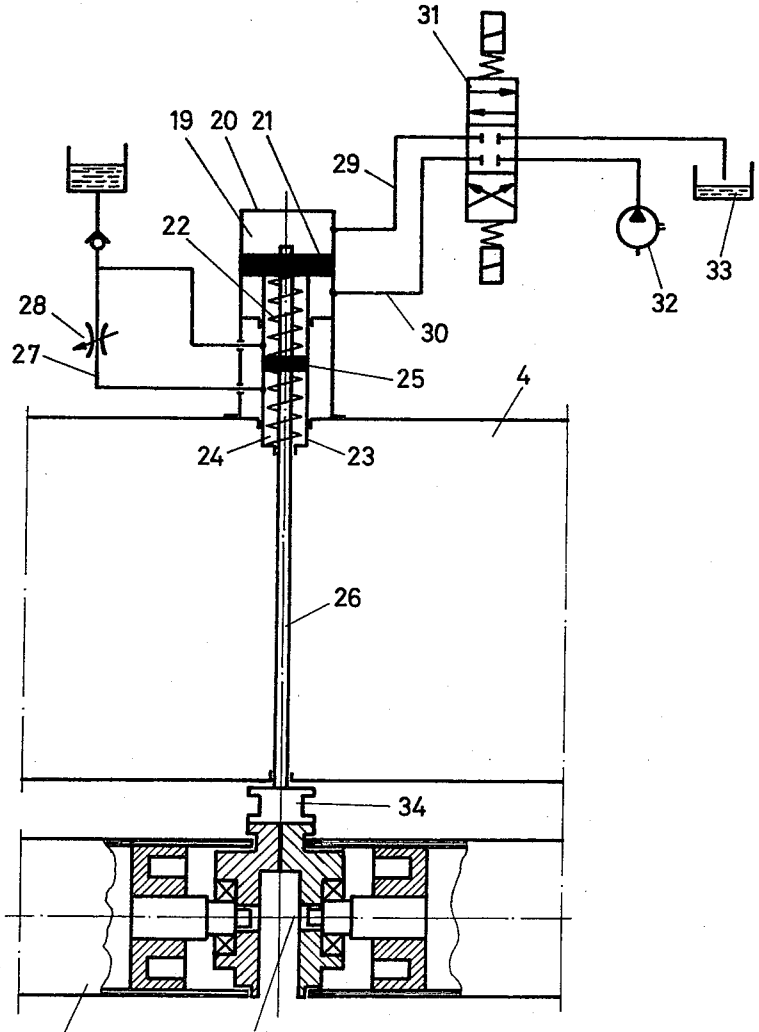

FIG. 1 shows a side view of an embodiment of the invention adapted to a two-drum winder, partly as a section and without the parts of which the frame consists, FIG. 2 is schematic frontal view of the embodiment shown in FIG. 1, FIG. 3 shows the detail A of FIG. 2 in enlarged scale, and FIG. 4 shows an other embodiment of detail A.

In the drawings, reference numeral 1 indicates a web roll being wound in a winder supported on drums 2 and 3. A transversal load beam 4 is supported at both its ends by hydraulic cylinders 5 attached to the frame of the winder. The lifting force of the hydraulic cylinders can be adjusted and will be increased as the diameter of the web roll increases in a manner known per se. Load rolls 6 are mounted in bearing brackets 7 and 8 in such a manner that the two adjacent load rolls which are mounted in the same bearing bracket 8, can tilt independently of each other. The outermost bearing 7 brackets are attached to pivot levers 9, one end of which is supported on a support member 10. The other end of the pivot lever is connected to the load beam 4 by a vibration absorber 11. The vibration absorber comprises a piston 12, a piston rod 13, a cylinder 14, and springs 15 on both sides of the piston supported on the heads of the cylinder. The piston divides the cylinder into two compartments, which are filled with liquid, for instance oil. The compartments are connected with each other through the line 16, in which there is a throttle valve 17. The leakage from the cylinder is compensated by oil from a tank 18.

As will be understood by the artisan, as the piston 12 is moved by applied vibratory forces the oil in the two compartments of cylinder 14 will be cycled back and forth through the throttle valve 17 to dissipate at least a part of the energy of such vibratory forces. The vibration absorber 11 thereby functions to dissipate and thus absorb vibratory energy.

The middle bearing brackets 8 are connected to the load beam 4 by a hydraulic member 19, which comprises a cylinder 20, a piston 21 to which the cylinder 23 of a vibration absorber 22 is attached. In the cylinder 23 there are springs 24 supported on the heads of the cylinder, a piston 25 and a piston rod 26. The liquid compartments of the vibration absorber are connected to each other through a line 27 in which there is a throttle valve 28. The liquid compartment on each side of the piston in the cylinder 20 are connected to a pump 32 and a tank 33 through lines 29, 30 and a control valve 31. The position of the piston 21 can thus be adjusted by feeding liquid to the compartment on one side of the piston while liquid is flowing out from the compartment on the opposite side of the piston. This makes it possible to move the bearing brackets 8 towards the web roll and away from it independently of each other and in relation to the outermost bearings. To the bearing brackets are connected load sensing means 34, by means of which the load on each load roll can be measured and which give signals which can be used to adjust the position of the bearing brackets 8 in such a way that an uniform nip pressure is achieved.

The movement of the load rolls caused by the irregular shape of the web roll generate forces acting on the pistons 12 and 25 of the vibration absorbers 11 and 22, which attempt to move the pistons and displace the liquid from one side of the piston to the other. As the displaced liquid flows through a throttle valve, the desired absorption of the vibration will be effected.

In the alternative embodiment shown in FIG. 4 there is a cylinder 35, divided by a partition 36 into two parts. In the one part 36 there is a hydraulically adjustable piston 38 which is attached to the load beam 4 by means of the piston rod 39. In the other part 40 there is a vibration absorbing piston 41 which by means of springs 42 is supported on one end of the cylinder and the partition, and is connected to the bearing bracket 8 through the piston rod 43. The function of this embodiment is the same as of the embodiment shown in FIG. 3.

The invention is not restricted to the disclosed embodiments, it may be modified in many ways and can for instance be adapted to prevent lateral vibrations in a winder.

What is claimed is:

1. A rider roll assembly in a winder comprising at least one load roll mounted on a movable transversal load beam and vibration absorbing means connecting the load roll to the load beam, said vibration absorber means including means operable to dissipate energy of vibrations absorbed.

2. A rider roll assembly in a winder comprising at least one load roll mounted on a movable transversal load beam and vibration absorbing means connecting the load roll to the load beam, said vibration absorbing means including a cylinder having a spring loaded piston and liquid compartments on both sides of the piston which are connected to each other through a line in which there is a throttle valve.

3. A rider roll assembly in a winder comprising at least one load roll mounted on a movable transversal load beam and vibration absorbing means connecting the load roll to the load beam, said vibration absorbing means being connected to hydraulic adjustment means.

4. A rider roll assembly according to claim 3, wherein the hydraulic adjustment means comprises a piston, hydraulic compartments on both sides of said piston which can be connected to a pressure source and a piston rod which constitutes the cylinder of the vibration absorbing means.

5. A rider roll assembly according to claim 3, wherein the cylinder of the hydraulic adjustment means and the cylinder of the vibration absorbing means have a common end plate.

6. A rider roll assembly according to claim 5, wherein the piston rod of the hydraulic adjustment means is attached to the load beam and the piston rod of the vibration absorbing means is attached to a bearing bracket of a load roll.

* * * * *